US007347498B2

(12) United States Patent
Clifford

(10) Patent No.: US 7,347,498 B2
(45) Date of Patent: Mar. 25, 2008

(54) SEATING DEVICE

(76) Inventor: Gerard Clifford, 9 Beacon St., Taunton, MA (US) 02780

( * ) Notice: Subject to any disclaimer, the term of this patent is extended or adjusted under 35 U.S.C. 154(b) by 0 days.

(21) Appl. No.: 10/856,097

(22) Filed: May 28, 2004

(65) Prior Publication Data

US 2004/0245837 A1 Dec. 9, 2004

Related U.S. Application Data

(60) Provisional application No. 60/475,520, filed on Jun. 3, 2003.

(51) Int. Cl.
*A47C 7/02* (2006.01)

(52) U.S. Cl. ..... 297/452.21; 297/452.22; 297/452.27; 297/284.11

(58) Field of Classification Search ..... 297/452.21, 297/452.22, 452.25, 452.26, 452.27, 452.28, 297/452.32, 452.37, 284.11; 5/653, 654, 5/643

See application file for complete search history.

(56) References Cited

U.S. PATENT DOCUMENTS

| | | | | | |
|---|---|---|---|---|---|
| 2,552,039 | A | * | 5/1951 | Flogaus | 297/452.26 |
| 2,865,436 | A | * | 12/1958 | Thorne | 297/440.11 |
| 3,167,351 | A | * | 1/1965 | Butler | 297/423.4 |
| 4,222,138 | A | * | 9/1980 | Rowley | 5/653 |
| 4,646,374 | A | * | 3/1987 | Shafer | 5/653 |
| 4,726,624 | A | | 2/1988 | Jay | 297/459 |
| 4,828,325 | A | | 5/1989 | Brooks | 297/458 |
| 4,837,881 | A | * | 6/1989 | Kondo et al. | 5/653 |
| 4,930,171 | A | * | 6/1990 | Frantz | 5/654 |
| 5,018,790 | A | | 5/1991 | Jay | 297/458 |
| 5,074,620 | A | | 12/1991 | Jay et al. | 297/337 |
| 5,092,655 | A | * | 3/1992 | Deegener et al. | 297/452.25 |
| 5,123,699 | A | | 6/1992 | Warburton | 297/219 |
| 5,189,747 | A | | 3/1993 | Mundy et al. | 5/654 |
| 5,288,135 | A | | 2/1994 | Forcier et al. | 297/452.21 |
| 5,294,181 | A | | 3/1994 | Rose et al. | 297/452.25 |
| 5,343,876 | A | * | 9/1994 | Rogers | 5/653 |
| 5,352,023 | A | * | 10/1994 | Jay et al. | 297/452.21 |
| 5,369,828 | A | * | 12/1994 | Graebe | 5/654 |
| 5,369,829 | A | | 12/1994 | Jay | 5/654 |
| 5,390,384 | A | * | 2/1995 | Dinsmoor et al. | 5/654 |
| 5,395,162 | A | | 3/1995 | Jay et al. | 297/452.25 |
| 5,457,833 | A | | 10/1995 | Jay | 5/654 |
| 5,461,741 | A | * | 10/1995 | Graebe | 5/654 |
| 5,462,339 | A | * | 10/1995 | Schmale et al. | 297/452.55 |
| 5,523,040 | A | | 6/1996 | Krouskop | 264/163 |

(Continued)

*Primary Examiner*—Sarah B. McPartlin
(74) *Attorney, Agent, or Firm*—Mark S. Leonardo; Shelly L. Dorn; Brown Rudnick Berlack Israels LLP

(57) ABSTRACT

A solid frame orthotic seating device for use in a sling seat that is supported by solid rails, such as a wheelchair. The solid frame orthotic seating device comprises a solid, rigid, non-collapsing, and durable interior skeletal frame with an elevated anterior wedge sloping down to the top surface of the frame, lateral well support arms, and a posterior well. The frame dimensions are designed to place the user's hips into flexion, position the user's pelvis in a neutral to anterior position, and position the user's buttocks into and or below the posterior well. The anterior wedge supports and distributes the weight of the user's body away from the buttocks. The strength and design of the solid frame uniquely promotes proper positioning, and helps to anchor the user by positioning their buttocks into and or below the posterior well and or below the solid lateral well support frame.

19 Claims, 8 Drawing Sheets

U.S. PATENT DOCUMENTS 5,551,756 A 9/1996 Gurasich et al. ..... 297/440.2
5,613,257 A * 3/1997 Graebe ..... 5/654
5,687,436 A * 11/1997 Denton ..... 5/653
5,701,621 A * 12/1997 Landi et al. ..... 5/691
5,797,155 A * 8/1998 Maier et al. ..... 5/654
5,833,319 A * 11/1998 Davis ..... 297/452.21
6,059,370 A 5/2000 Kanyer et al. ..... 297/452.36
6,082,824 A * 7/2000 Chow ..... 297/452.56
6,241,320 B1 6/2001 Chew et al. ..... 297/452.26
6,378,947 B1 4/2002 Barber et al. ..... 297/452.25
6,425,153 B1 7/2002 Reswick ..... 5/655.9
6,502,263 B1 1/2003 Rowley et al. ..... 5/654
6,536,791 B1 3/2003 Adams ..... 280/250.1
6,571,411 B1 * 6/2003 Ebe ..... 5/653
6,755,477 B2 * 6/2004 Chow ..... 297/452.56
2005/0023872 A1 * 2/2005 Hetzel et al. ..... 297/256.16

* cited by examiner

SEATING DEVICE

CROSS-REFERENCE TO RELATED APPLICATIONS

This patent application claims priority from U.S. Provisional Patent Application No. 60/475,520, filed Jun. 3, 2003, the contents of which are incorporated herein by reference in its entirety.

BACKGROUND

1. Technical Field

The present disclosure generally relates to a seating device, and more particularly, to an orthotic seating device for use in a sling seat.

2. Background of the Related Art

Many elderly, disabled, and bariatric persons are prone to positioning abnormalities while seated in standard wheelchairs.

Positioning abnormalities include sacral sitting and sliding from the seat, lateral leaning tendencies, strong forward leaning tendencies, and other leaning or slouching posture while sitting in a chair. Severe and chronic positioning abnormalities can increase the users risk of injury, including risk of falls, risk of aspiration, risk of respiration and digestive complications, and risk of pressure sores (decubitus ulcers). These problems can require professional attention or hospitalization, and are costly to treat. Individuals experiencing these problems are subjected to discomfort, pain and even premature demise.

Chronic positioning problems also have quality of life issues for affected persons, making simple tasks such as eating, drinking, or maintaining eye contact difficult or even impossible without seating correction. Positioning problems that limit the patient's ability to sit securely in a wheelchair can also result in the patient spending considerable time in bed or in a geriatric recliner. Spending significant waking hours in an abnormal position can result in psycho/social set backs, increased use of medications, reduced caloric and fluid intake, aspiration and respiration problems, and may result in increased risk of injury.

Furthermore, persons spending large amounts of time sitting in wheelchairs and other chairs, who lack the ability to shift their weight, are susceptible to pressure sores from a concentration of pressure around areas of bony prominence, such as the ischial tuberosities and coccyx. According to the Merck Manual of Geriatrics, the estimated prevalence of pressure sores in geriatric long term care facilities is as high as 23%, and among home care patients, as high as 12.9%. Pressure sores are painful to the patient, costly to the facility, and increase mortality rates in elderly patients.

Therefore, it would be desirable to overcome the disadvantages and drawbacks of the prior art with a seating device that provides improved posture correction, pressure relief, and seating stabilization. It would be highly desirable if the seating device and its constituent parts are easily and efficiently manufactured and assembled.

SUMMARY

Accordingly, a seating device is disclosed that provides improved posture correction, pressure relief, and seating stabilization. The seating device and its constituent parts are easily and efficiently manufactured. Other objects and advantages of the present disclosure are set forth in part herein and in part will be obvious therefrom, or may be learned by practice of the present disclosure that is realized and attained by the instrumentalities and combinations pointed out in the appended claims for the devices and methods of the present disclosure consisting of its constituent parts, constructions, arrangements, combinations, steps and improvements herein shown and described.

The seating device of the present disclosure may include parts that rest on the rigid rails of a wheelchair sling seat. The advantage of this construction is that a posterior well is created, as opposed to a seating device that rests directly on the collapsible sling seat causing poor positioning of a user.

In one particular embodiment, a seating device is provided, in accordance with the principles of the present disclosure. The seating device includes a rigid skeletal frame having a top surface and a bottom surface, an elevation at an anterior of the frame, a well located at a posterior of the frame, and; pressure conforming material juxtaposed to the frame and adapted to conform to a user's anatomy upon use of the device. Upon use of the device, at least part of the user's buttocks are positioned into the well and can extend below the bottom surface of the frame. The user's legs are elevated and the user's hips are placed in flexion. The elevation has a predetermined height and said elevation slopes downward at a predetermined slope toward said top surface near a middle of the frame. The predetermined height and slope determine a hip flexion angle. The user's pelvis can be caused to be in a neutral to anterior tilt, and the user's torso is placed in an upright and midline position.

In another embodiment, the frame of the device includes a wedge shaped elevation; a posterior well positioned between two well supports arms, wherein the posterior well is an open space in the frame; and a plurality of pressure conforming layers covering the frame and adapted to conform to a user's anatomy upon use of the device. The wedge shaped elevation includes a plurality of surfaces at angles to each other. The elevation has a predetermined height and at least one of the elevation surfaces slopes downward at a predetermined slope. The pressure conforming layers include a first layer of high-density sheet foam covering the frame; a second layer of heat sensitive, pressure-equalizing, visco-elastic foam covering the first layer; and a third layer of high-density sheet foam applied over the second layer. The anterior elevation extends substantially the width of the frame, and the posterior well extends nearly the width of the frame.

In another embodiment, the seating device is used in a sling seat supported by opposing rails of a wheelchair. The device comprises a rigid, solid frame having a width and a length substantially those of the sling seat, the frame including an elevated anterior wedge having a plurality of sides at angles to each other, wherein the wedge is adapted to support a user's legs; a first well support and a second well support, first and second well supports for resting on respective opposing rails of the wheelchair, the first and second well supports extending laterally along sides of the frame from midframe to a rear thereof; a posterior well between the well supports and extending nearly the width of the frame, wherein the well is an open space in the frame adapted to receive a user's buttocks; and a plurality of pressure conforming layers covering the frame and adapted to conform to a user's anatomy upon use of the device. The wedge, posterior well, and pressure conforming materials cooperate to prevent a concentration of pressure on the ischial tuberosity and/or coccyx of the user, so that a risk to the user of developing decubitus ulcers is minimized. The wedge, posterior well, and pressure conforming materials cooperate to prevent the user's buttocks from bottoming out in the sling seat. The pressure conforming materials are covered with material that is washable, and resists moisture and bacteria. Upon use of the device, the elevation elevates the user's legs, and the user's buttocks are positioned into/below the posterior well. The wedge, posterior well, and pressure conforming materials cooperate to distribute the user's weight from their buttocks to their legs and back.

DETAILED DESCRIPTION OF EXEMPLARY EMBODIMENTS

The exemplary embodiments of the orthotic seating insert or device disclosed are discussed in terms of a seating device for use in a sling seat that is supported by rails, such as a sling seat of a wheelchair. The presently disclosed seating device provides posture correction, pressure relief, and seating stabilization by way of a rigid frame covered by pressure conforming material(s) that mold to the anatomy of a user seated in the sling seat with the device inserted. It is contemplated that the seating device may also be employed with other chairs that employ a sling seat, and also other rehabilitation apparatus that accommodate orthotic seat inserts.

The following discussion includes a description of an orthotic seating device in accordance with the present disclosure. Reference will now be made in detail to the exemplary embodiments of the disclosure, which are illustrated in the accompanying figures.

Figure 1:
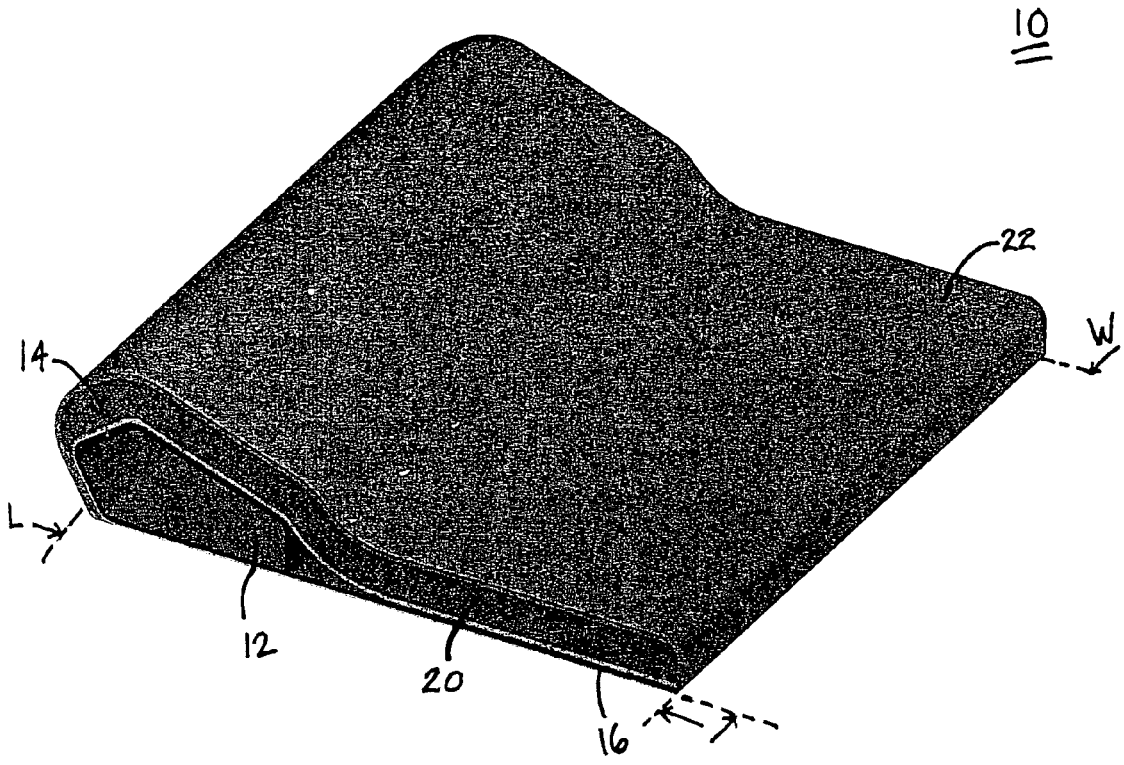
FIG. 1 is a cutaway perspective view of the seating device in accordance with the principles of the present disclosure.
Figure 2:
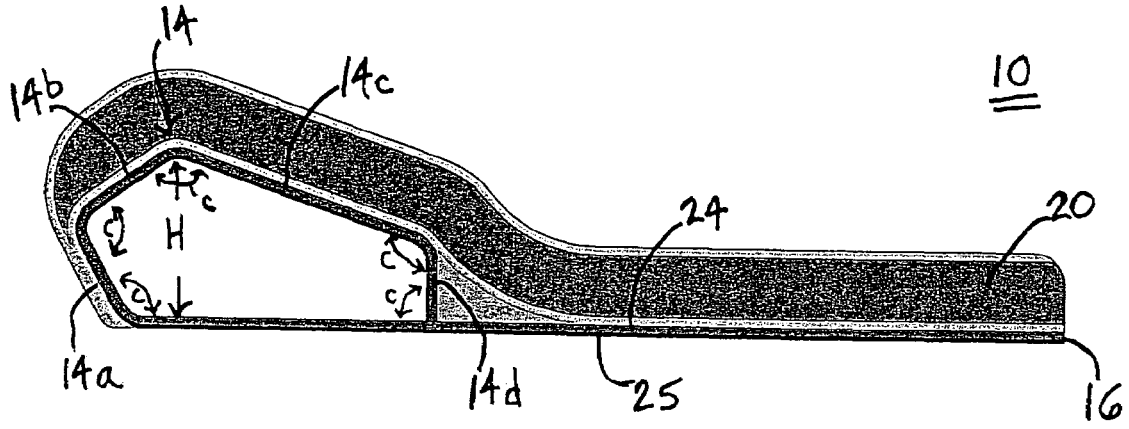
FIG. 2 is a cutaway side view of the seating device shown in FIG. 1.
Figure 3:
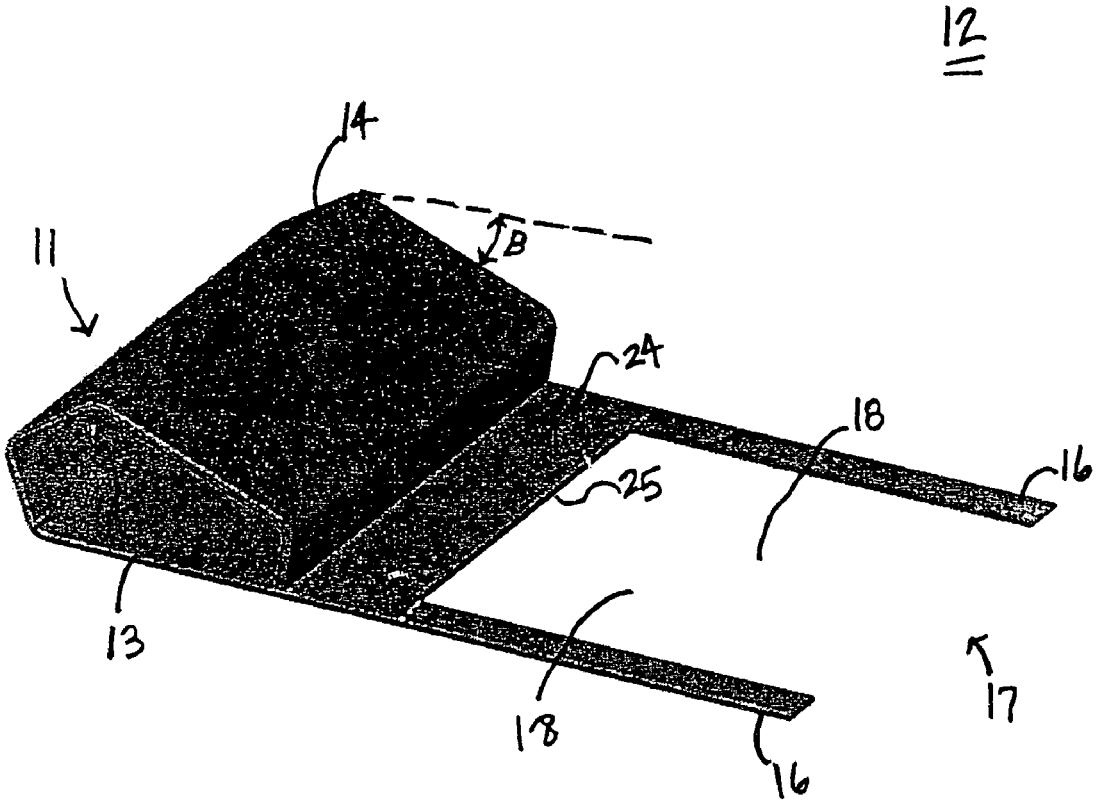
FIG. 3 is a perspective view of the internal frame of the seating device shown in FIG. 1.
Figure 4:
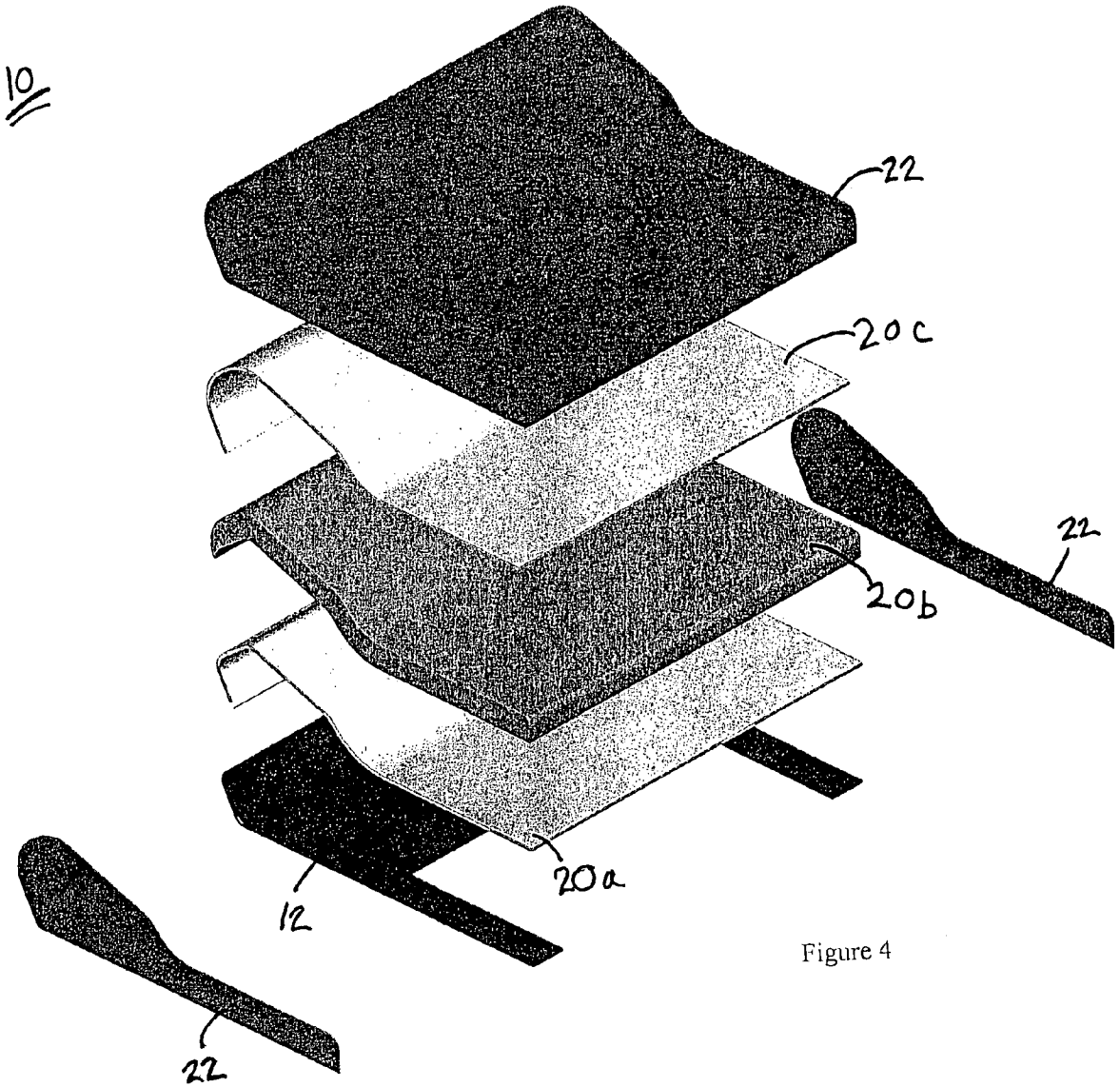
FIG. 4 is an cutaway perspective view of the pressure conforming materials of the seating device shown in FIG. 1.
Figure 5:
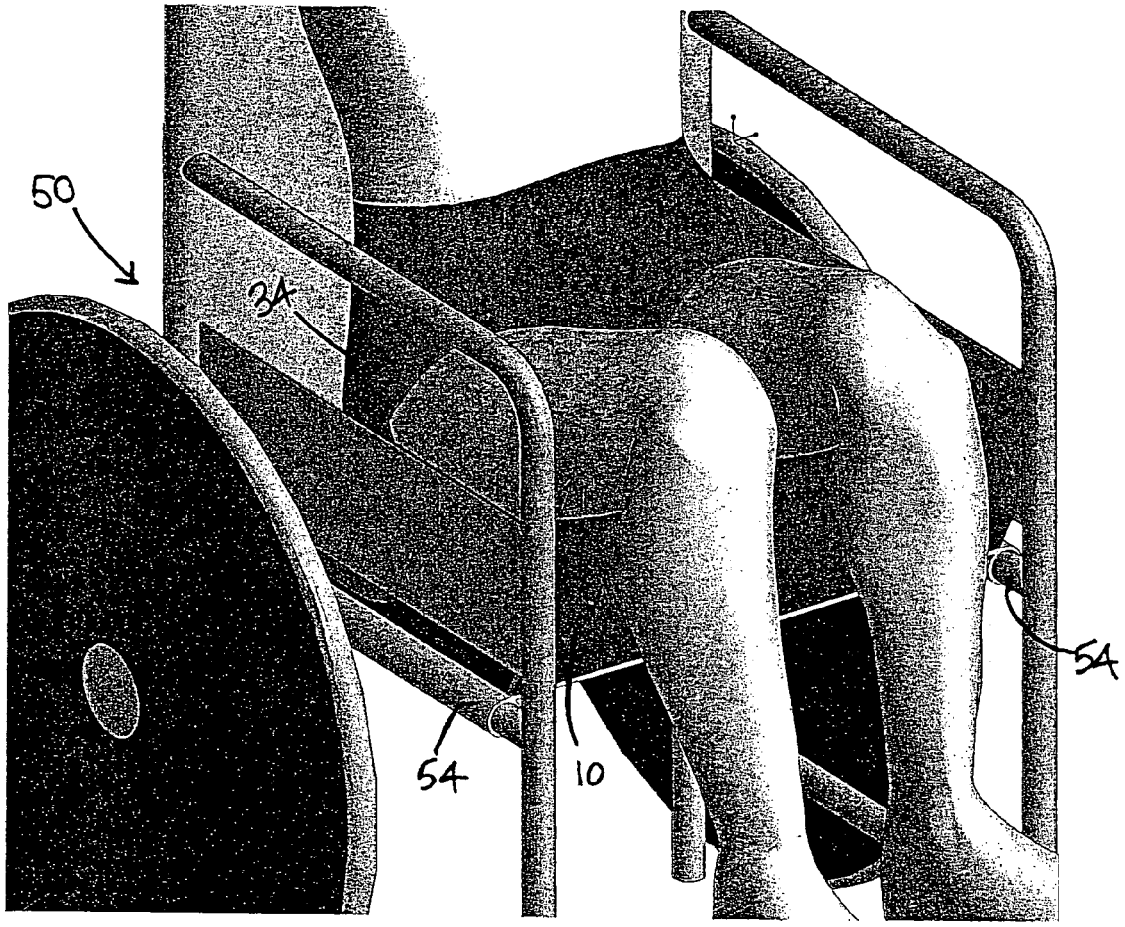
FIG. 5 is a perspective view of a user in a wheelchair fitted with the seating device shown in FIG. 1.
Figure 6:
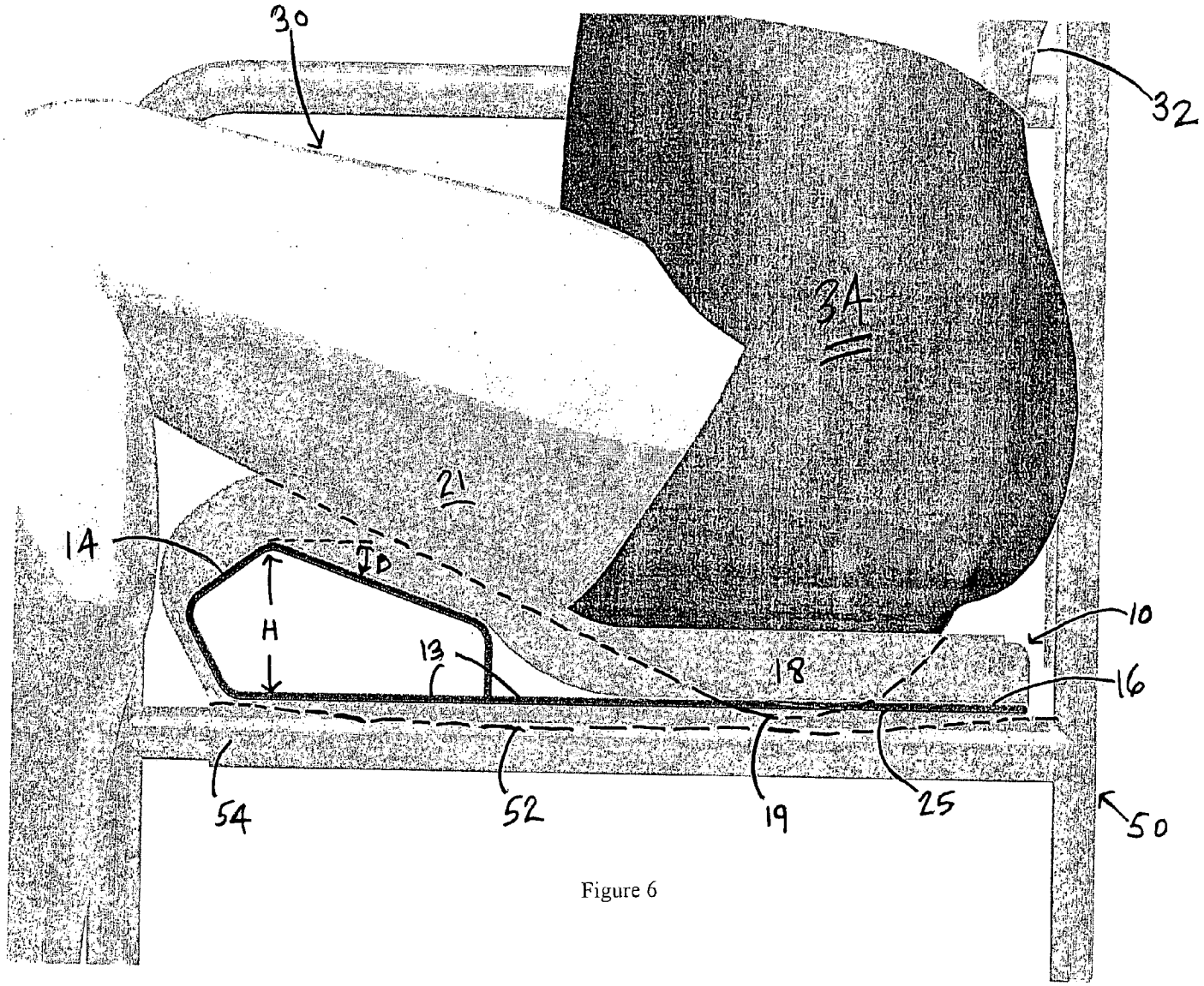
FIG. 6 is a cutaway side view of the wheelchair fitted with the seating device shown in FIG. 5.
Figure 7:
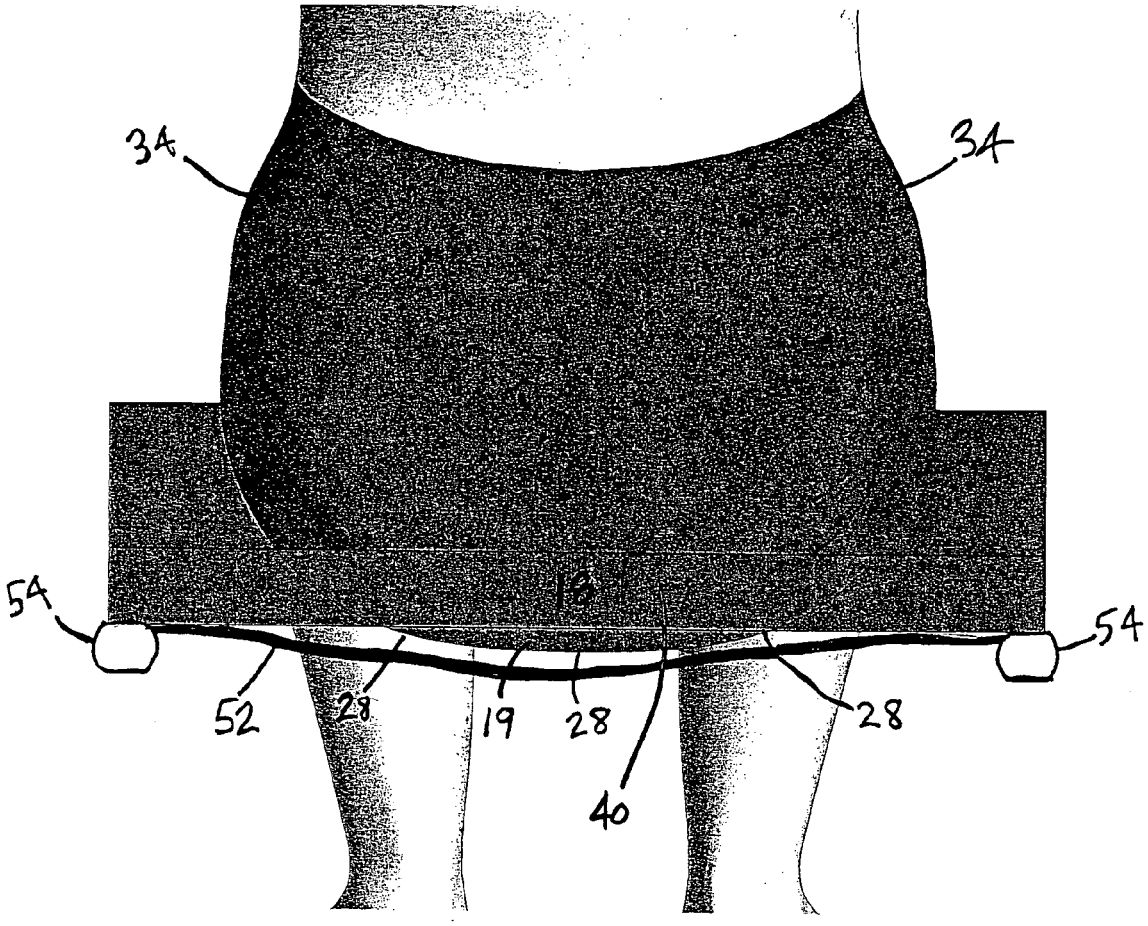
FIG. 7 is a cutaway rear view of the user in a wheelchair fitted with the seating device shown in FIG. 5.
Figure 8:
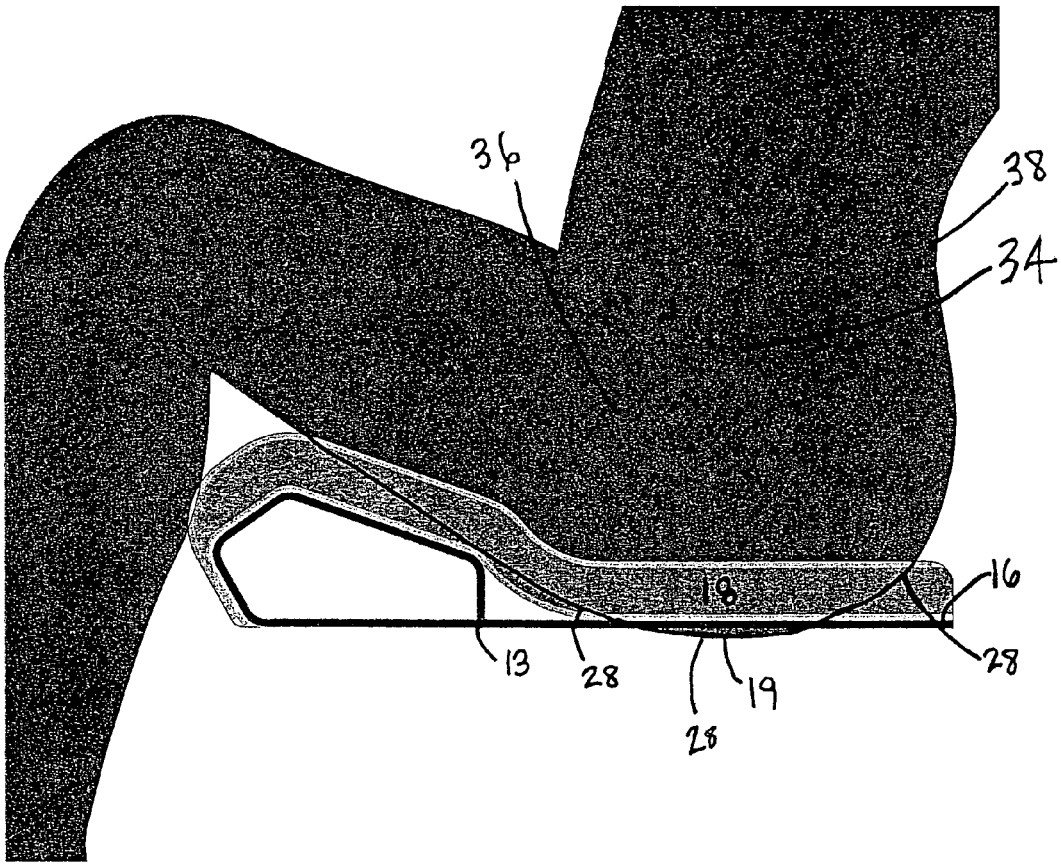
FIG. 8 is a cutaway side view of a user seated in the seating device shown in FIG. 1.

Turning now to the figures, wherein like components are designated by like reference numerals throughout the several views. Referring initially to FIGS. 1-8 there is illustrated an orthotic seating device 10, constructed in accordance with the principles of the present disclosure. Device 10 may be used in a sling seat 52 supported by the solid rails 54 of a wheelchair 50.

Device 10 includes an internal skeletal frame 12 constructed of solid, rigid, flame retardant material. Frame 12 acts as a stable, durable and non-collapsing foundation for device 10. The interconnected components of frame 12 include a base 13; an anterior elevation or wedge 14; lateral well supports arms, well supports or supports 16; and posterior well or well 18. Frame 12 includes an anterior portion or, end 11, a posterior portion, or end 17, a top surface 24, a bottom surface 25, a length L, a width W and a height H. Length L and width W of frame 12 are substantially those of sling seat 52 in which device 10 fits. However, the dimensions of frame 12 and its components can vary to accommodate different wheelchair sizes, and the user's size and positioning requirements. More specifically, configuration of frame 12 and it's components can be customized to facilitate the positioning and pressure management requirements of each user as identified by a physician, therapist, nurse or other care provider.

Base 13 is planar and horizontal and extends lengthwise from anterior 11 to near midframe. Anterior elevation or wedge 14 is elevated from base 13 at anterior 11 and extends the width thereof. Wedge 14 comprises three to five, preferably four, sides or surfaces 14*a*-14*d* disposed at various angles C relative to each other and to base 13. These angles C can be varied based on therapeutic goals. At least one side 14*c* may slope downward at a predetermined slope B toward top surface 24. Wedge 14 has a height H preferably between approximately 0.25" to 4.5". Although anterior elevation 14 is shown having a wedge shaped cross section, the cross section may instead be of various other shapes suitable for the purpose, such as, for example, rectangular, oval, triangular, etc.

Well supports 16 are elongated and extend laterally on either side of frame 12 from approximately mid-frame to posterior 17. Whereas prior art seating supports rest directly on wheelchair sling seat 52, the rigid well supports 16 of the present disclosure instead rest on wheelchair rails 54. Consequently, the integrity of the "well" effect is maintained, and the user is alleviated from experiencing pressure from a flat, hard surface.

Posterior well 18 is positioned between well supports 16 and thus extends nearly the width of frame 12. More specifically, well 18 is an open space in frame 12 designed to accommodate the user's posterior anatomy, including the buttocks 19. Upon use of device 10, buttocks 19 rest at a level into and/or below posterior well 18. More specifically, buttocks 19 extend below bottom surface 25. This facilitates improved positioning and pressure relief as explained below.

Frame 12 is covered with pressure conforming materials 20 which mold to the user's anatomy and aid in pressure relief, as further described below. Device 10 is protected by a moisture proof, anti-bacterial cover 22.

Frame 12 places the user's hips 34 into flexion, promotes pelvic positioning and support, and promotes stable, upright and midline positioning in wheelchair 50. More specifically, upon use of device 10, elevated wedge 14 and posterior well 18 cooperate to put the user's hips 34 into flexion. With the user's thighs 21 elevated by wedge 14 and buttocks 19 positioned into and/or below posterior well 18, the force of gravity positions the user's pelvis 36 in, for example, a neutral to anterior tilt, and places the torso in an upright and midline position. Advantageously, predetermined height H and slope B of wedge 14 determine the angle of the user's hip 34 flexion, the position of the pelvis 36, and the user's recline. Wedge 14 and posterior well 18 cooperate to distribute the weight of the user from buttocks 19 to the legs 30 and the back 32. Accordingly, the user is placed and maintained in an upright and midline sitting position through proper positioning of the pelvis 36 and stabilization of the hips 34 and pelvis 36.

Advantageously, device 10 also prevents points of pressure and reduces or minimizes the risk of skin breakdown. For example, elevated wedge 14, posterior well 18 and lateral well supports 16 cooperate to offload the weight of the user from areas 28 susceptible to pressure sores. In particular, posterior well 18 accommodates areas 28 of bony prominence such as the ischial tuberosities and coccyx, so that pressure on these areas 28, and thus the risk of pressure sores, are minimized.

Device 10 also secures the user in wheelchair 50. In particular, wedge 14 and posterior well 18 cooperate, aided by gravity, to position the user's buttocks 19 into and/or below posterior well 18. In addition, when the user's hips 34 are placed in flexion, the buttocks 19 become anchored into/below posterior well 18.

This positioning secures the user in the wheelchair seat and reduces/minimizes the risk of falling/sliding therefrom. Accordingly, device 10 provides an alternative to prior art devices that undesirably rely on lap belts and lap trays to restrain wheelchair users. Such "active restraints" are known to have negative physical and emotional effects on users.

Frame 12 is covered with a plurality of pressure conforming materials 20. Materials 20 can have, for example, a tri-laminate foam composition. A first layer 20*a*, such as, for example, thin high-density sheet foam or like material, covers the upper surface(s) of frame 12. A second layer 20*b* of thicker pressure relieving material covers first layer 20*a*. Second layer 20*b* may be heat sensitive, pressure-equalizing visco elastic foam or like material. A third layer 20*c* of thin high-density sheet foam is applied over second layer 20*b*. These pressure conforming materials 20 conforms to the patient's anatomy to provide pressure relief while preventing the user from bottoming out in sling seat 52. This prevents a concentration of pressure on areas 28 susceptible to pressure sores, such as the ischial tuberosities or coccyx. Pressure conforming materials 20 may be covered with a protective cover 22 that is moisture proof (incontinence proof), washable, antimicrobial and the like.

Device 10 provides the advantages described above including posture correction, pressure relief, and seating stabilization. In particular, frame 12 provides a solid, stable, non-collapsing foundation that correct the posture of the user in wheelchair 50, and maintains structural integrity during repeated use of device 10. Wedge 14 and posterior well 18 cooperate to promote a stable symmetrical position of the user's pelvis 36 and hips 34. This promotes an upright, midline seating position for the user.

Frame 12 and pressure conforming materials 20 cooperate to provide pressure relief. Sling seat 52 concentrates pressure on a user's buttocks 19, causing pressure sores on areas 28 of bony prominence such as the coccyx or ischial tuberosity. Advantageously, wedge 14 and posterior well 18 cooperate to minimize these pressure points 28 and the risk of pressure sores. In particular, wedge 14 distributes the user's weight more evenly and removes the focal point of pressure from buttocks 19. Posterior well 18 positions buttocks 19 into and/or below posterior well 18 to further improve positioning and relieve pressure.

Pressure conforming materials 20 provide additional pressure relief through the conforming properties of the heat sensitive foam and the deep cushion area 40 formed by posterior well 18. As the user's body comes in contact with device 10, body heat warms the pressure relieving layer 20*b* surrounding frame 12. As layer 20*b* warms, it becomes malleable and conforms to the dimensions of the user's anatomy. High-density foam layers 20*a*, 20*c* provide further pressure relief while maintaining firmness to prevent the user from bottoming out in sling seat 52.

Wedge 14 and posterior well 18 cooperate to provide seating stabilization for the user. In particular, posterior well 18 biases the user rearward in the wheelchair seat, and enables the user's buttocks 19 to extend below bottom surface 25 of frame 12. In this way, gravity anchors the user securely in device 10. Furthermore, gravity assists placing the user's buttocks slightly below bottom surface 25 of frame 12, and anchors the user in the seat so to reduce the risk of sliding or falling therefrom. In this way, device 10 improves securement of the user once they have attained their position in wheelchair 50.

Certain general comments are in order. To most effectively distribute the user's weight evenly over his or her back 32, buttocks 19, thighs 21, and feet 62, the user's feet 62 should be properly positioned and supported by the foot supports 64 of wheelchair 50 in accordance with well known principles of wheelchair use, and preferably under the supervision of a healthcare provider. It is further noted that device 10 can include safety straps 60 for attachment the rear of wheelchair 50 so to further secure device 10 therein. In addition, non-slip strips such as Dycem (not shown) or a similar barrier can be used to cover any exposed bolts on sling seat 52 of wheelchair 50 that can snag the materials on device 10 and cause it to tear. Device 10 should fit snugly on top of sling seat wheelchair 50 with which it will be used. In this connection, device 10 can be manufactured in various sizes to fit standard size wheelchairs, or manufactured in custom sizes to fit a particular or odd-size wheelchair.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. A seating device comprising:

a. a rigid skeletal frame having a top surface and a bottom surface, the frame including:

a five-sided elevation at an anterior of the frame having five substantially flat sides, the five sided elevation having a first horizontal bottom side, a second side extending upwardly and forwardly from a forward end of said first horizontal bottom side, a third side extending upwardly and rearwardly from said second side, a fourth side extending downwardly and rearwardly from said third side and a fifth vertical back side joining an end of said fourth side and a rearward end of said first horizontal bottom side, well support arms each having a posterior end extending from the anterior of the frame toward a posterior of the frame and defining a space between the posterior ends of the well support arms at the posterior of the skeletal frame and;

b. pressure conforming material juxtaposed to the elevation, the pressure conforming material extending along substantially the entire length of the well support arms and adapted to conform to the user's anatomy upon use of the device.

2. The device of claim 1, whereupon use of the device, said pressure conforming material covers the posterior frame opening and allows at least part of a user's buttocks to extend through said posterior frame opening and below said bottom surface of the frame.

3. The device of claim 1, wherein the rigid skeletal frame is for use in a sling seat and is configured to place the user's hips into flexion, promote pelvic positioning and support, and promotes stable, upright and midline positioning.

4. The device of claim 1, wherein upon use of the device, the user's legs are elevated and the user's hips are placed in flexion.

5. The device of claim 1, wherein said elevation has a predetermined height and slopes downward at a predetermined slope toward said top surface.

6. The device of claim 5, wherein said predetermined height and slope determine a hip flexion angle.

7. The device of claim 1, wherein upon use of the device, the user's pelvis is caused to promote a neutral to anterior tilt, and the user's torso is placed in an upright and midline position.

8. The device of claim 1, wherein the elevation, posterior opening, and pressure conforming material cooperate to distribute the user's weight from the user's buttocks to the user's legs and back.

9. The device of claim 1, wherein the pressure conforming material is covered with a protective material that is washable, and resists moisture and bacteria.

10. The device of claim 1, wherein upon use of the device, the elevation elevates the user's legs while the user's buttocks are positioned into the posterior opening.

11. An orthotic seating device comprising:

a. a rigid skeletal frame having a length and a width, the frame including:

a polygonally-shaped elevation at an anterior end of the frame, the elevation having five substantially flat sides, the polygonally-shaped elevation having a first horizontal bottom side, a second side extending upwardly and forwardly from a forward end of said first horizontal bottom side, a third side extending upwardly and rearwardly from said second side, a fourth side extending downwardly and rearwardly from said third side and a fifth vertical back side joining an end of said fourth side and a rearward end of said first horizontal bottom side;

well support arms each having a posterior end extending lengthwise from a middle of the frame toward a posterior end thereof defining a space between the posterior ends of the well support arms at the posterior of the skeletal frame;

a posterior well positioned between the well supports arms, wherein the well is an open space in the frame, and;

b. a plurality of pressure conforming layers, the pressure conforming layers extending along substantially the entire length of the well support arms, covering the frame and adapted to conform to a user's anatomy upon use of the device.

12. The device of claim 11, wherein said sides of said polygonally-shaped elevation extend at angles to each other.

13. The device of claim 12, wherein said elevation has a predetermined height and at least one of the elevation sides slopes downward at a predetermined slope.

14. The device of claim 13, wherein said predetermined height is in the range of approximately 0.25 to 4.5 inches.

15. The device of claim 11, wherein the pressure conforming layers include a first layer of high-density sheet foam covering the frame; a second layer of heat sensitive, pressure-equalizing, visco-elastic foam covering the first layer; and a third layer of high-density sheet foam applied over the second layer.

16. The device of claim 11, wherein said anterior elevation extends substantially the width of the frame.

17. The device of claim 11, wherein the posterior well extends nearly the width of the frame.

18. An orthotic seating device for use in a sling seat supported by opposing rails of a wheelchair, the device comprising:

a. a rigid, solid frame having a width and a length substantially those of the sling seat, the frame including:

an elevated anterior polygonally-shaped wedge having five sides at angles to each other, wherein the wedge is adapted to elevate and support a user's legs, the polygonally-shaped wedge having a first horizontal bottom side, a second side extending upwardly and forwardly from a forward end of said first horizontal bottom side, a third side extending upwardly and rearwardly from said second side, a fourth side extending downwardly and rearwardly from said third side and a fifth vertical back side joining an end of said fourth side and a rearward end of said first horizontal bottom side, a first well support and a second well support each having a posterior end, wherein said first and second well supports rest on respective said opposing rails of the wheelchair, the well supports defining a space between the posterior ends of the well supports at the posterior end of the skeletal frame, a posterior well between the well supports and extending nearly the width of the frame, wherein the well is an open space in the frame adapted to receive the user's buttocks; and b. a plurality of pressure conforming layers covering the entire frame including the elevated anterior wedge, the entire length of the first well support, the entire length of the second well support and the posterior well between the well supports, where the plurality of pressure conforming layer are adapted to conform to the user's anatomy upon use of the device.

19. The device of claim 1, wherein the elevation, posterior opening, and pressure conforming material cooperate to prevent a concentration of pressure on the buttocks of the user.

* * * * *